US006341572B1

(12) United States Patent
Howell et al.

(10) Patent No.: US 6,341,572 B1
(45) Date of Patent: Jan. 29, 2002

(54) EXPLOSION PREVENTION SYSTEM FOR INTERNAL TURRET MOORING SYSTEM

(75) Inventors: Gordon B. Howell, Cypress; David A. Jones, Missouri City; Jarrell H. Young, Houston; Lloyd D. Witten, Spring; Asis Nandi, Houston; Richard M. Corder, Sealy, all of TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/518,490

(22) Filed: Mar. 3, 2000

Related U.S. Application Data

(60) Provisional application No. 60/122,630, filed on Mar. 3, 1999.

(51) Int. Cl.[7] ..... B63B 21/00

(52) U.S. Cl. ..... 114/230.12; 114/230.13; 166/356; 166/363; 441/4

(58) Field of Search ..... 166/336, 356, 166/357, 363, 364; 73/35.17; 169/45, 47, 49, 67, 69; 114/230.12, 230.13; 441/3, 4, 5; 454/228, 229, 234, 238, 369

(56) References Cited

U.S. PATENT DOCUMENTS

| | | | | | |
|---|---|---|---|---|---|
| 3,709,302 | A | | 1/1973 | Stults | |
| 3,730,278 | A | * | 5/1973 | Roy | 169/49 |
| 3,770,059 | A | | 11/1973 | Graham | |
| 3,919,855 | A | * | 11/1975 | Turner | 220/560.05 X |
| 4,081,039 | A | | 3/1978 | Wardlaw | |
| 4,254,521 | A | | 3/1981 | Papmahl | |
| 4,433,733 | A | * | 2/1984 | Cunningham | 169/49 |
| 4,766,836 | A | | 8/1988 | Bechar et al. | |
| 4,899,827 | A | | 2/1990 | Poole | |
| 4,989,750 | A | * | 2/1991 | McGarvey | 220/560.01 |
| 5,240,446 | A | * | 8/1993 | Boatman et al. | 441/3 |
| 5,255,722 | A | * | 10/1993 | Furstenberg | 141/114 |
| 5,292,271 | A | * | 3/1994 | Boatman et al. | 441/3 |
| 5,437,332 | A | | 8/1995 | Pfeffer | |
| 5,564,957 | A | | 10/1996 | Breivik et al. | |
| 5,662,865 | A | * | 9/1997 | Blatchford | 422/29 |
| 5,829,964 | A | * | 11/1998 | Derrick et al. | 431/202 |
| 5,860,840 | A | * | 1/1999 | Boatman et al. | 441/5 |
| 5,909,776 | A | * | 6/1999 | Stewart et al. | 169/26 |
| 6,059,620 | A | * | 6/2000 | Yetman | 441/4 |
| 6,093,068 | A | * | 7/2000 | Turner et al. | 441/5 |

OTHER PUBLICATIONS

NFPF69; "Standard on Explosion Prevention Systems of the National Fire Protection Association (NFPA)", 1997, pp. 69.1–69.33.

Inert Gas Systems, International Maritime Organization (IMO), 1990, pp. 1–88.

* cited by examiner

*Primary Examiner*—David Bagnell
*Assistant Examiner*—Jong-Suk Lee
(74) *Attorney, Agent, or Firm*—James L. Jackson; Andrews, Kurth, Mayor, Day, Caldwell & Keeton

(57) ABSTRACT

A method and apparatus for ensuring against explosion of the gaseous atmosphere of a closed chamber, such as the QDCD room of an internal turret of an offshore production and offloading buoy wherein the closed chamber has production risers and conduit connectors that represent a potential source of flammable gas. The method comprises mixing and diluting the oxidant content of the air by introducing within the closed chamber a sufficient quantity of inert gas to render the mixture of the air and any flammable gas non-combustible regardless of the flammable gas content of the mixture. The method includes removal of the non-combustible mixture of air and any flammable gas from the closed chamber by purging thereof to the natural atmosphere, while introducing inert gas, thereby leaving a substantially inert atmosphere within the closed chamber. The turret system provides for control of the gaseous atmosphere within the closed chamber at all modes of turret operation, including the idle, on-line and ventilation modes and also provides for gas pressure control to accommodate normal operating conditions and conditions of gas leakage into the chamber.

10 Claims, 2 Drawing Sheets

10
14
18
20
16
12
23
38
44
48
34
36
50
40
30
42
46
84
80
82
78
72
76
22
74
26
62
64
68
52
28
32
15
60
70
58
56
24
13
66
54

EXPLOSION PREVENTION SYSTEM FOR INTERNAL TURRET MOORING SYSTEM

Applicants hereby claim the benefit of U.S. Provisional application Ser. No. 60/122,630 filed on Mar. 3, 1999 by Jarrell H. Young, Lloyd D Witten, Asis Nandi, Richard M. Corder, Gordon B. Howell and Davis A. Jones and entitled Explosion Prevention System For Internal Turret Mooring System, which Provisional Application is incorporated herein by reference for all purposes.

BACKGROUND OF THE INVENTION

1. Field of the Invention

This invention relates generally to safety systems for preventing explosions in internal turret mooring systems where risers which are carrying hydrocarbons from subsea wells are connected to lines leading to process facilities. In particular the invention relates to an atmosphere control system for preventing explosions in such a mooring system.

2. Description of the Prior Art

In the past, ventilation has been the basis for preventing explosion due to leaks between risers and surface equipment of a turret mooring system. Ventilation systems have inherent difficulties in that explosion potential can remain unacceptably high under certain conditions.

Systems and methods based on the principle of filling an enclosure with inert gas are known in the art of safety systems for marine vessel cargo tanks and in land hydrocarbon storage tanks. Inert gas systems used on marine vessel cargo tanks are described in a book, *Inert Gas Systems,* International Maritime Organization (IMO), 1990. Guidelines are provided which apply to inert gas system on tankers, particularly to cargo tankers for hydrocarbons. The guidelines are based on current general practice used in the design and operation of inert gas systems using flue gas from the uptake from the ship's main or auxiliary boilers, and installed on crude oil tankers and combination carriers. The guidelines provide a method with an inert gas system where the protection against a tank explosion is achieved by introducing inert gas into the tank to keep the oxygen content low and reduce to safe proportions the hydrocarbon gas concentration of the tank atmosphere. It can be determined from flammability diagrams that as inert gas is added to hydrocarbon/air mixtures, the flammable range progressively decreases until the oxygen content reaches a level generally taken to be about 11% by volume, below which point no mixture can burn. There are three methods of replacement of gas in cargo tanks, namely: inerting, purging, and gas-freeing. The general policy of cargo tank atmosphere control is that tankers fitted with inert gas systems should have their cargo tanks kept in a nonflammable condition at all times. In line with that policy, tanks should be kept in the inert condition whenever they contain cargo residues or ballast. The oxygen contents should be kept at 8% or less by volume with a positive gas pressure in all the cargo tanks. The atmosphere within the tank should make the transition from the inert condition to the gas-free condition without passing through the flammable condition. In practice this means that before any tank is gas-freed, it should be purged with inert gas until the hydrocarbon content of the tank atmosphere is below the critical dilution line. When a ship is in a gas-free condition before arrival at a loading port, tanks should be inerted prior to loading.

A second inerting method and system is described in a publication, *NFPA* 69: *Standard on Explosion Prevention Systems,* of the National Fire Protection Association (NFPA), 1997. The standard described in this publication applies to systems and equipment used for the prevention of explosions by the prevention or control of deflagrations (i.e., combustion with velocities less than the speed of sound).

The standard outlines the minimum requirements for installing systems for the prevention of explosions in enclosures that contain flammable concentrations of flammable gases, vapors, mists, dusts, or hybrid mixtures. Recognized techniques are grouped into two classes in the standard: one based on preventing combustion; the other based on preventing or limiting damage after combustion occurs.

One method of the standard for preventing combustion provides for oxidant concentration reduction which is a technique for maintaining the concentration of the oxidant (e.g. oxygen) in a closed space below the concentration required for ignition to occur. The technique for oxidant concentration reduction for deflagration prevention can be considered for application to any system where a mixture of oxidant and flammable material is confined to an enclosure within which the oxidant concentration can be controlled. The system is maintained at an oxidant concentration low enough to prevent a deflagration by using a purge gas (e.g., inert gas such as nitrogen). Flammability diagrams for specific flammable gases or vapors are used as a basis for determining the level of limiting oxidant concentrations (LOC).

U.S. Pat. No. 5,564,957 discloses an arrangement for dynamically positioning a vessel with thrusters and connecting a riser buoy in a lower receiving module at a submerged place at the bottom of the hull of the vessel. The buoy has an outer buoyant portion anchored to the sea bed by anchor legs. The outer portion of the buoy is locked to the vessel. An inner part of the buoy is rotatably mounted centrally of the outer part. A riser runs from the sea bed to the central part of the buoy which can be removably secured to a flow line of the vessel which leads to storage holds. A long vertical shaft runs from the vessel deck to the connection of the riser at the top of the central part of the buoy to the vessel flow line. Inert gas and ventilation are applied to the shaft from the inert gas and ventilation system of the vessel. Further the shaft at its upper end is provided with a shutter for closing the shaft. The shaft and the upper part of the receiving space can thereby be filled with inert gas (after removal of water) as a safety precaution prior to start of transfer of combustible or inflammable fluids.

Ventilation is also employed for atmosphere control in closed chambers for combustible concentration reduction by mixing and diluting combustible gas in air, followed by removal of the chamber atmosphere mixture via exhausting to the natural atmosphere on topsides of the vessel. This presupposes that combustible gas is present, as in the case of an accidental leak (i.e., upon confirmed detection of the presence of the combustible gas). Ventilating, either continuously or on demand (i.e., upon confirmed detection of gas), is intended to reduce the combustible gas concentration low enough (i.e., below the LEL of the gas) to prevent the formation of a flammable atmosphere. A disadvantage of ventilation for atmosphere control is that, unless the ventilation is designed to deliver a very high number of air changes per hour, even a moderate hydrocarbon release rate may be sufficient to overwhelm the ventilation system and result in a combustible gas concentration between the LEL and UEL (i.e., the flammable range), the atmosphere is potentially flammable, thereby increasing the probability of an explosion. Although for very large releases, the combustible gas concentration could pass through the flammable range quicker, thereby reducing the probability of an explosion, the problem of exhausting the gas after a leak has been controlled still presents a hazard, since ventilating with air would require the atmosphere to pass through the flammable range again. It is desirable therefore to ensure that, regardless of the characteristics of a gas leak within the closed chamber, the atmosphere within the closed chamber will not pass through the flammable range either during the leakage or during clearing of the leaked combustible from the closed chamber.

A disadvantage of employing continuous ventilation for atmosphere control within the QCDC room is that moist sea air is introduced into the atmosphere of the room, allowing for accelerated corrosion and subsequent degradation of critical equipment and instrumentation (e.g., ESD valves and actuators). The effects of corrosion and degradation are compounded in terms of increased risk by the increased potential for leaks from degradation over the life of the equipment. The necessity for more frequent maintenance and repair to control corrosion and degradation creates increased exposure of personnel to hazards as work is conducted within the QCDC room. Also, since more frequent maintenance and repair is needed, the potential for human error is increased. Continuous ventilation (while diluting the combustible/air mixture sufficient to maintain a combustible concentration below the LEL) may actually mask a small hydrocarbon leak, and therefore would not allow detection and correction of the leak before the situation worsens. Any appreciable sized hydrocarbon leak would overwhelm the ability of the ventilation system to dilute the combustible/air mixture sufficiently to maintain a combustible concentration below the LEL. Even if the ventilation system is shut down upon confirmed gas detection at 60% LEL, a high pressure gas release could itself present a static electricity hazard and ignite the gas in the presence of oxygen as the gas concentration passes through the flammable range. Additionally, a ventilation system running continuously at very high air interchange rates provides a potential for ignition sources posed by its metal parts. Further, a ventilation system running continuously at high volume consumes a significant amount of energy, thus adding significantly to the operational costs of the turret mooring system.

SUMMARY OF THE INVENTION

A primary object of this invention is to provide an improved atmosphere control system using inert gas principles for an internal turret mooring system based on the NFPA 69 standard described above.

Another object of the invention is to provide an atmosphere control system based on inerting principles which significantly reduces the risk of explosion in a mooring turret, because preventing the formation of a flammable mixture eliminates the probability of ignition.

Another object of the invention is to provide an inerting system for a turret moored FPSO, as opposed to a ventilation system, in order to provide lower capital and operating costs in a relatively simple design, the effectiveness of which relies only on the availability of a continued supply of nitrogen and maintaining an enclosure integrity.

It is also an object of the present invention to provide a structure with a substantially closed chamber within which leakage of a flammable medium may occur and to maintain the gaseous atmosphere of the chamber in a nonflammable condition by introduction of an inert gas such as nitrogen, flue gas, carbon dioxide or the like sufficient to render the chamber atmosphere oxidant defficient.

It is another object of the present invention to provide a QCDC chamber within an internal turret mooring system and a chamber inerting system for ensuring the presence within the chamber of a non-flammable atmosphere even under circumstances where flammable hydrocarbons may exist by leakage from production risers and also having the capability of changing the atmosphere of the chamber to provide for the safe presence therein of maintainance workers.

It is also an object of the present invention to provide a QCDC chamber within an internal turret mooring system which is designed to be maintained at a positive environment pressure, above atmospheric pressure to minimize the potential for oxidant intrusion into the chamber.

It is an even further object of the present invention to provide a QCDC chamber within an internal turret mooring system which is designed to sustain a predetermined leakage developed overpressure and to vent excessive pressure in the event a high volume leak should be developed within the chamber.

Oxidant concentration reduction in the QCDC room could be achieved by mixing and diluting the oxidant (oxygen present in air) by introducing an inert gas (e.g., nitrogen), followed by removal of this atmosphere by purging to the natural atmosphere on topsides. This method renders and maintains an atmosphere nonflammable, regardless of the combustible gas concentration, thereby completely eliminating the potential for combustion. Inerting of a substantially closed atmosphere in this manner eliminates the need for continuous ventilation, and thus eliminates potential introduction of moist sea air into the closed QCDC room so that degradation of the equipment and instrumentation therein by corrosion is minimized. In fact, a continuously inerted enclosure would actually inhibit the corrosion normally expected from an air atmosphere within the QCDC room. This would reduce the inspection frequency and reduce maintenance activities (and manning levels), as well as any risk associated with these activities. It is anticipated that the capital and operating costs of an atmosphere control system employing inerting according to the principles of the present invention would be significantly less than a continuous ventilation type atmosphere control system. The oxidant concentration reduction method of the present invention is based on the inherently safe principal of "attenuation", i.e., using materials under less hazardous conditions. In this case, the attenuation strategy is physical (i.e., dilution) rather than chemical. Thus the preventative method of inerting is preferable to the mitigation method of continuous ventilation.

Briefly, the objects identified above and other features and advantages of the present invention are incorporated in a novel arrangement of an enclosure, referred to as a Quick Connect/Disconnect Room (QCDC) defined by a roof and wall section of the turret and by a wall section and floor of the top of a spider buoy. Surface safety valves, piping, and instrumentation that are critical to isolating hydrocarbon inventories between subsea equipment and the turret, which represent potential leak sources, are located in the enclosure or QCDC room and thus are potential sources of leakage of combustibles into the QCDC room. It is of course desirable that combustible leakage does not occur within the QCDC room, but if it does, it is highly desirable that the combustible leakage be prevented from presenting a danger of explosion.

The enclosure and associated vent ducts and ancillary equipment for the enclosure provide several functions. The enclosure ducts and ancillary equipment provide a space and system for filling and maintaining a volume of inert gas to displace oxygen and prevent formation of a flammable atmosphere when production from the subsea wells to the vessel via the turret is on-line. The enclosure and associated equipment serve as a secondary containment facility in case of a gas leak, with the capability to vent hydrocarbon gas to the atmosphere to prevent overpressure of the enclosure. The enclosure and associated equipment further provide a work area for service personnel that can be adequately ventilated to provide a safe working atmosphere when occupied by personnel to perform maintenance after production is shut down.

By controlling the atmosphere differently for various operating modes, the enclosure and associated vents and ancillary equipment provide flexibility in operation, yet allow for the inherently safe feature of maintaining a non-flammable atmosphere at all times, thereby significantly reducing risk of explosion. It should be borne in mind that the term "inert gas" from the standpoint of the present invention, shall mean a pure inert gas or a substantially inert gas that can contain small percentages of other gases, including oxygen, but when introduced into an enclosure in the presence of air and a combustible gas, will reduce the oxidant content of the enclosure gas mixture sufficiently that combustion of the mixture will not occur, regardless of the volume of combustible gas within the mixture.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DETAILED DESCRIPTION OF PREFERRED EMBODIMENT

Figure 1:
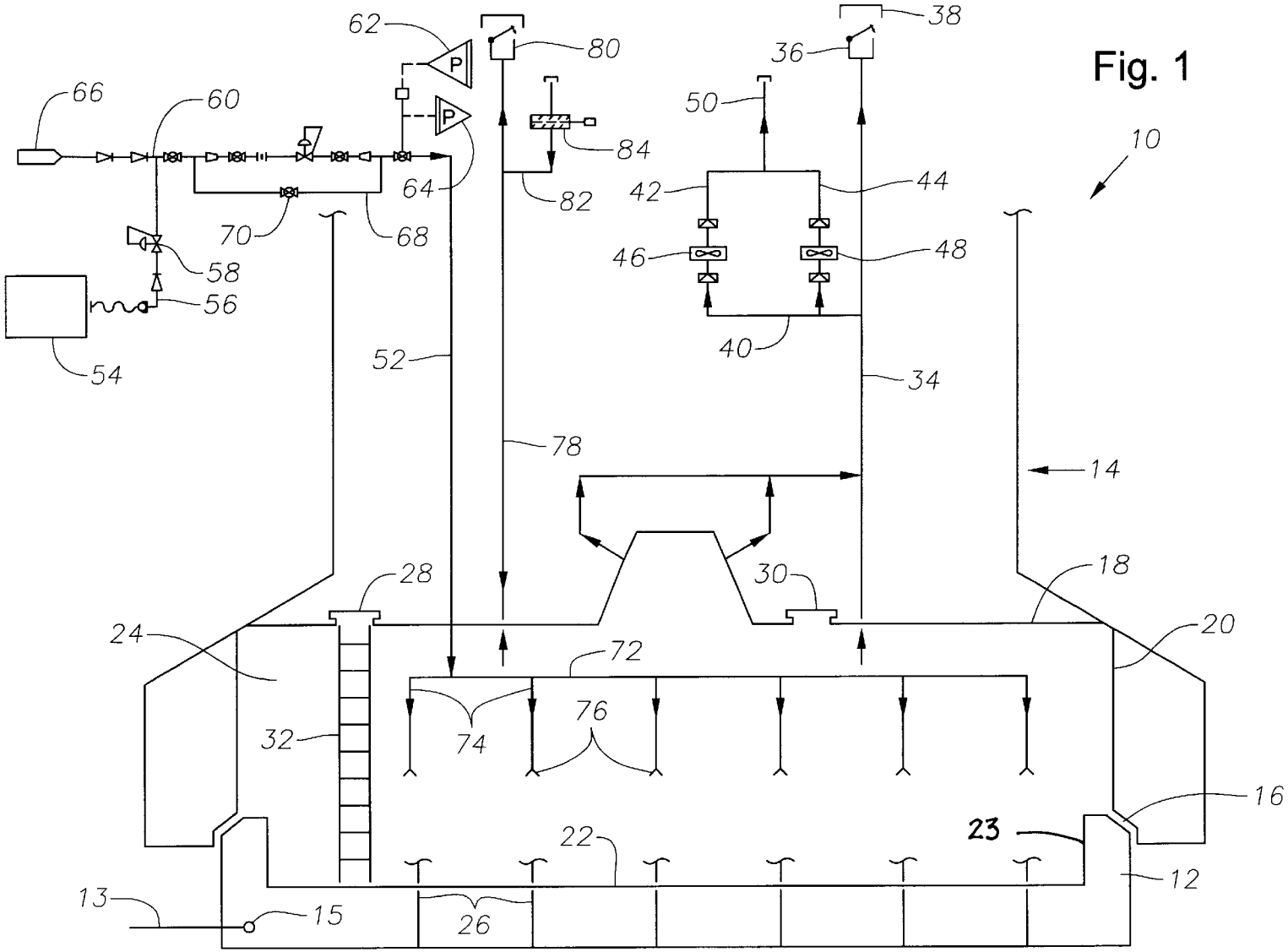
FIG. 1 is a schematic illustration of a turret and a spider buoy and an enclosure (called a Quick Connect/Disconnect (QCDC) room) formed by the lower walls of the turret, the upper surface of the spider buoy and a roof.

Referring now to the drawings and first to FIG. 1 a schematic illustration of the preferred embodiment of the explosion prevention system for the internal turret 14 of a Floating Production Storage and Offloading (FPSO) vessel is shown generally at 10 which is secured in substantially stationary mooring condition when secured to the upper portion of a mooring buoy 12, also known as a spider buoy, which is anchored to the sea floor by anchor legs 13 connected to the mooring buoy structure 12 at connecting points 15. The turret 14 provides the attachment and rotation point of the single point mooring system for the FPSO vessel and provides the point for the connection and disconnection of the mooring system and the flexible riser system. Quick connect/disconnect (QCDC) valve assemblies for each production riser are housed in the QCDC room 24, an enclosure located at the base of the turret shaft and being cooperatively defined by structures of buoy 12 and turret 14. These risers contain hydrocarbons in the form of gas for gas injection/lift and gas/crude oil for production and test.

Hydrocarbon gas in the gas injection riser, containing methane and other light ends, presents the greatest hazard in the QCDC room due to its high operating pressure. Because the gas is composed of approximately 74% methane, this component is used as the primary combustible gas for discussion purposes. In practice, the combustible gas may be a hydrocarbon gas or vapor from either the gas injection/lift streams or from any of the production risers.

To minimize risks of handling flammable hydrocarbons, various turret process and safety systems, according to the present invention, have been designed for prevention, detection, mitigation and emergency response. The principal objective of the present invention is the prevention of the development of a flammable atmosphere within the QCDC room in a wide variety of conditions and during changes from one condition to another.

The FPSO vessel 10 is rotatably secured about an internal turret shown generally at 14 by means of a seal 16 so that the vessel 10 can rotate about the turret 14 to accommodate tanker movement responsive to changes in the direction of water movement, wind, etc.

As shown in FIG. 1, the lower part of the turret 14 is provided with a roof panel 18, called a QCDC room roof, in order to provide an enclosure of the lowest area of the turret where combustible gas leak sources present the greatest potential risk and where an inert atmosphere can be contained. The QCDC room roof 18, turret wall structure 20 and floor structure 22 and wall structure 23 of the mooring buoy 12 cooperatively, collectively define a QCDC room or chamber 24 receiving production risers typically extending from wells located at the sea floor and conducting the flow of hydrocarbons, including crude oil, natural gas and any water contained therein to a tanker vessel that is moored to the turret. Sealing means 16 between the QCDC room walls 20 of the turret and 23 of the buoy 12 to minimize leakage of gas from the QCDC room or chamber 24 and thus permit the chamber 24 to be maintained at a positive pressure, slightly above atmospheric pressure to ensure against oxidant invasion of the chamber as will be discussed in detail below.

It is intended that the QCDC room or chamber 24 be accessible to personnel for inspection, repair or replacement of certain system components, but that during the flow of production fluid through the risers 26, no personnel will be permitted to enter the QCDC room or chamber 24. For personnel access to the QCDC room 24, the QCDC room roof 18 is provided with personnel entry hatches 28 and 30, with a personnel ladder 32 being located at the hatch 28. A portable personnel ladder may also be located within the QCDC room 24 so as to be available for use as needed by personnel working within the chamber 24. Other personnel hatches may be strategically located on the QCDC room roof to promote efficiency of QCDC room access and safety of service personnel.

When the QCDC room 24 contains a non-combustible atmosphere, i.e., having insufficient oxidant concentration to support combustion of any combustible medium present within the QCDC room, and it becomes necessary for personnel to enter the QCDC room, such as for inspection and maintenance activities, it is desirable to provide means for quickly removing the inert gas and ventilating the room so as to also remove any combustible medium contained therein. This is accomplished by energizing one or more exhaust fans that are provided in exhaust ducting, with the access hatches 28 and 30 open to admit air into the room for exhaust fan purging of both the inert gaseous medium and the combustible gaseous medium from the room.

To accomplish QCDC room exhausting and venting activity an exhaust/vent duct 34 penetrates the QCDC room roof 18 and provides for diverting gases trapped in the QCDC room (gases such as combustible gas, inert gas, air) to the atmosphere at a safe location during inerting, venting, gas-freeing and ventilating operation. The exhaust/vent duct 34 extends to a condensation vent 36 which is protected by a weather hood 38 to prevent entry of rain into the exhaust/vent duct 34. A suction exhaust/vent duct 40 is in communication with the duct 34 and is provided with primary and secondary exhaust ducts 42 and 44, each having an exhaust fan 46 and 48 respectively. The discharge of each of the exhaust fans is communicated via the ducts 42 and 44 with an exhaust discharge duct 50. The exhaust fans 46 and 48 are provided in redundant fashion so that, in the event one of the exhaust fans should become inoperative, the other exhaust fan will be operative to exhaust the QCDC room 24, thus ensuring the operational capability and safety of the internal turret system. In the event a leakage of significant volume should occur within the QCDC room 24, such as due to the rupture of a riser line 26, excessive leakage of a valve, etc., the vent line 34, with its exhaust fans 46 and 48 may be activated either automatically responsive to pressure sensors within the QCDC room or by manual control to provide for additional venting and exhausting capability.

It is desirable to maintain within the QCDC room 24 an atmosphere including a sufficient percentage of inert gas that the oxidant concentration within the atmosphere of the room will render the atmosphere non-flammable. Oxidant concentration reduction in the QCDC room can thus be achieved by mixing and diluting the oxidant (oxygen present in air) by introducing an inert gas (e.g., nitrogen), followed by removal of this atmosphere via purging to the natural atmosphere on topsides of the vessel. This method renders and maintains an atmosphere non-flammable, regardless of the combustible gas concentration, thereby completely eliminating the potential for a combustion. Inerting takes advantage of the flammability diagram for a particular combustible gas. The inert gas most commonly used for inerting the QCDC room is nitrogen, though flue gas and carbon dioxide as well as other inert gases may also be used if desired. Although common in applications when hydrocarbon liquids and vapors are present in closed systems, the use of flue gases is considered impractical for turret applications primarily on the basis of the potential personal and environmental hazards associated with the handling of such gases. Furthermore, the use of flue gases is also impractical since there are currently no provisions to transport such gases from topsides to the turret via the swivel stack. Carbon dioxide is also used frequently for inerting applications, but it is considered impractical for turret applications because of its additional expense, as compared to nitrogen, because it is heavier than air and because it forms carbonic acid when combined with water or moisture, thus promoting corrosion. Carbon dioxide can also present an electrostatic hazard if used as a compressed gas. In contrast, nitrogen is considered the best choice for turret inerting applications because it is readily available topsides, it is relative inexpensive in comparison to other inert gases, it is non-toxic and does not present a toxic hazard if released to areas where personnel can be exposed (although, like carbon dioxide, it is a simple asphyxiant and requires certain safety precautions). Carbon dioxide is environmentally friendly, in that nitrogen is a natural component of air and can be reintroduced into the natural atmosphere without any environmental dangers. Carbon dioxide is slightly lighter than air, serves to retard corrosion due to oxidation and is considered compatible with all process fluids and materials of construction in the QCDC room.

The QCDC room atmosphere control system functions primarily as a means for reducing the oxygen concentration within the QCDC room sufficiently to ensure against combustion of the gaseous mixture therein, regardless of the percentage of flammable medium therein. This is achieved by flooding the QCDC room with an inert gas (preferably nitrogen) in order to render the atmosphere non-flammable, or non-ignitable, thereby reducing the potential for an explosion within the QCDC room from a combustible leak from a riser. Besides inerting, the atmosphere control system also functions as a means for venting, gas-freeing and ventilating the QCDC room atmosphere. The atmosphere control system inerts the enclosure by reducing the oxygen concentration of the atmosphere within the room to a level at which combustion cannot be supported, regardless of the amount of combustibles present. The atmosphere control system also maintains the atmosphere of the enclosure in an inerted condition at any time production is on-line so that a combustible leak cannot develop an explosive atmosphere in the room. Under circumstances where a combustible leak occurs, the atmosphere control system has a venting capability for venting combustible leaks to mitigate leaks within the enclosure. The atmosphere control system also has the capability for purging the QCDC room of combustible gas with inert gas, so that subsequent gas-freeing operations will at no time create a flammable atmosphere. The atmosphere control system also eliminates the need for air to enter the enclosure during normal operations except when it is necessary for the enclosure to be free of inert gas, such as for personnel entry. At such time the atmosphere control system has the capability for ventilating the QCDC room with fresh air so that personnel can enter the QCDC room and remain therein for extended periods of time, such as for servicing, repairing or replacing any of the equipment therein. The atmosphere control system also provides certain monitoring activities within the QCDC room, such as pressure monitoring, oxidant percentage monitoring, inert gas percentage monitoring and combustible gas monitoring.

Inert gas is provided to the QCDC room via a gas supply line 52 from the inert gas supply of the vessel and which is in communication with the room or chamber 24 through the the QCDC room roof 18 as shown in FIG. 1. An inert gas, e.g., nitrogen generator 54 is provided topsides, with its discharge line 56 connected across a pressure control valve 58 to supply manifold line 60 to which the supply line 52 is connected. The manifold line 60 is provided with inert gas pressure detectors 62 and 64 which provide for automatic inert gas cut-off in the event the supply pressure is either insufficient or excessive for the QCDC room. Automatic shut-off of the inert gas supply also triggers energization of the exhaust/vent fan system so that the room 24 can be immediately purged of gas and ventilated. In the event of failure of the inert gas supply, backup inert gas bottles (for example, compressed nitrogen bottles) are also provided as shown at 66. The backup inert gas supply is in controlled connection with the supply line 60 and is thus controlled by the same pressure control equipment as discussed above in connection with the primary inert gas supply system. An inert gas bypass line 68 is connected with the supply line 60 and is controlled by a throttle valve 70 to enable continuation of the inert gas supply even in circumstances where the control equipment of the supply line is in need of service.

The inert gas supply line 52 passes through the QCDC roof 18 and is connected with a gas supply header 72 to which individual gas distribution conduits 74 are connected. The distribution conduits are each provided with a distribution nozzle or fitting 76 which accomplishes inert gas distribution within the QCDC room 24. The distribution nozzles 76 and their location within the QCDC room are also designed to develop significant turbulence within the QCDC room to assist in efficiently mixing the inert gas with the environmental gas within the room. Thus, in the event the environmental gas should contain a significant percentage of flammable constituents, the inert gas will render the oxidant percentage below the lower explosive limit (LEL) of the flammable gas, i.e., the lowest concentration of a flammable gas or vapor in air at atmospheric pressure capable of being ignited. Below the LEL, mixtures including flammable constituents are too "lean" to burn. Conversely, the (UEL) is the upper explosive limit of the flammable gas, so that any flammable gas mixture above the UEL is too "rich" to burn. The flammable range, under ordinary circumstances, is the range of flammable gas mixture that is between the UEL and LEL. Even under this condition, however, an inert gas, such as nitrogen, can sufficiently minimize the oxidant content of the mixture so that the mixture is non-flammable, regardless of the combustible gas concentration.

The enclosure defined by the QCDC room 24, including its hatches and seals is designed to withstand an overpressure up to a predetermined limit caused by leakage of gas from the riser piping and flow controlling system. For example, though not to be considered limiting of the invention, in the preferred embodiment of the present invention, the enclosure is designed to withstand an overpressure of 300 kPa (2 barg) from a combustible gas release of ~500 kg/s inside the enclosure. Two vent ducts being represented schematically at 78 in FIG. 1, are sized at 914 mm (36 inch) to provide sufficient venting capacity to limit the enclosure overpressure to 300 kPa (2 barg) from a combustible gas release of ~500 kg/s inside the enclosure.

In the event of gas leakage into the substantially closed chamber defined by the QCDC room 24, the vent line or lines 78, and the associated control equipment thereof have the capability of venting chamber overpressure under the control of a pressure relief assembly 80. Since a positive pressure is maintained within the QCDC room 24 at all times, when the production risers 26 are actively flowing production fluid or a gaseous medium is being utilized for gas-lift production, etc. atmospheric intrusion into the QCDC room cannot occur; thus the gaseous mixture within the QCDC room will remain oxidant deficient even though leakage of an otherwise combustible medium should be continuously leaking into the QCDC room. In the event additional venting capacity is needed to prevent overpressure within the QCDC room, a vent line 82 having an actuated damper 84 is activated either manually or automatically as needed to accommodate additional venting capacity.

Other devices and systems are provided as indicated symbolically and schematically in FIG. 1. Such devices and systems include:

(1) Apparatus which delivers inert gas to the QCDC room enclosure during inerting operations, including the appropriate control schemes for the steps of charging, purging, and topping up the QCDC room enclosure.

(2) Apparatus which monitors the enclosure atmosphere.

(3) Apparatus which protects the enclosure from excessive pressure.

(4) Apparatus which prevents backflow of enclosure gases into the inert gas supply system or other areas of the turret.

(5) Apparatus which mixes the enclosure atmosphere as inert gas is introduced.

(6) Apparatus which mechanically forces air through the QCDC room enclosure for purging inert gas during the inert gas-freeing operation, and for providing fresh air on a continuous basis and exhausting any contaminants during the ventilating operation.

(7) Apparatus which controls the ignition hazards presented by electrical devices and sources of static electricity.

(8) Apparatus which provides access to the enclosure by personnel for periodic inspection and maintenance activities.

(9) Apparatus which safeguards personnel from the potential hazard of a pressurized enclosure.

(10) Apparatus which restricts personnel access to the enclosure at all times to prevent unauthorized entry into this confined space.

(11) Apparatus which restricts personnel from access to the upper turret levels during venting and gas-freeing operations to minimize direct exposure to potentially inert and/or combustible gases.

(12) Apparatus which isolates the inert gas supply to the enclosure during the inert gas-freeing operation and during the ventilating operation.

(13) Apparatus which isolates the exhaust fans during the inerting operation to prevent the introduction of oxygen into an inerted enclosure.

(14) Apparatus which insures that production remains off-line when personnel have entered the enclosure and while the exhaust fans are in service.

(15) Apparatus which shuts down the exhaust fans upon confirmed detection of combustible gas during the ventilating operation when maintenance activities in the enclosure are being performed.

(16) Apparatus which insures that environmental conditions do not adversely affect the operation and availability of the system.

Advantages of the Arrangement of FIG. 1—By controlling the atmosphere differently for various operating modes, the system design described above by reference to FIG. 1 provides flexibility in operation, yet allows for the inherently safe feature of maintaining a nonflammable atmosphere at all times, thereby significantly reducing the risks of explosions due to gas leaks compared to other methods such as combustible concentration reduction via ventilation.

Surface safety valves, piping, and instrumentation that are critical to isolating hydrocarbon inventories between subsea equipment and the turret, and that represent potential leak sources, are located in the QCDC room enclosure at the base of the turret shaft. The enclosure is formed by the turret wall, a roof, and a floor (served by the top of the spider buoy). The enclosure and associated vent ducts and ancillary equipment are designed for multiple use as:

(1) a containment facility for filling and maintaining a volume of inert gas to displace oxygen and prevent formation of a flammable atmosphere when production is online;

(2) a secondary containment facility in case of a gas leak, with the ability to vent hydrocarbon gas to the natural atmosphere; and (3) a work area that can be adequately ventilated when occupied by personnel to perform maintenance after production is shut down.

Method of Operation of the Explosion Prevention System—The operating philosophy of atmosphere control system for the QCDC room enclosure which is based on three requirements:

(1) The QCDC room enclosure atmosphere should be kept in the inert condition whenever the possibility exists from a leak of hydrocarbons into the enclosure from risers. Thus, the QCDC room is maintained in an inert condition when the production system of the turret is on-line and a pressure condition exists in the production risers and the control valving and instrumentation associated therewith.

(2) The QCDC room enclosure atmosphere should make the transition from the inert condition to the gas-free condition without passing through the flammable condition. In practice, this means that before the enclosure is gas-freed of combustible gases, it is first purged with inert gas until the combustible content of the atmosphere is diluted below the critical dilution line (i.e., below the LEL).

(3) When the enclosure atmosphere is in a gas-free condition, it is re-inerted prior to production coming back on-line.

Figure 2:
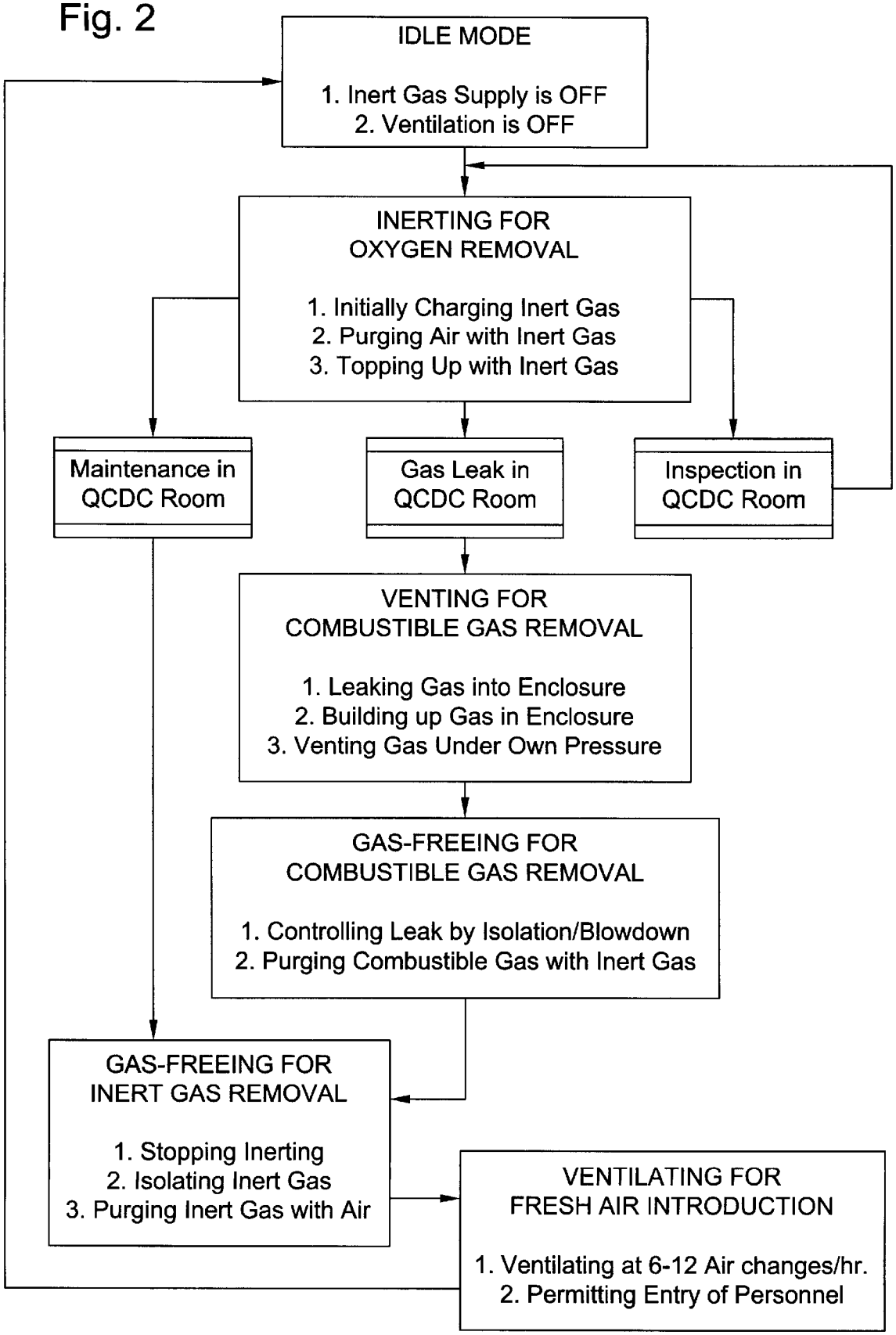
FIG. 2 is a schematic of operating procedures for an atmosphere control system for the explosion prevention system.

With this philosophy in mind, the operating sub-steps of the various operating modes are presented in FIG. 2 for three major modes or events:

I. Maintenance in the QCDC room enclosure;

II. Gas Leak in the enclosure; and

III. Inspection in the enclosure

As indicated above, the QCDC room enclosure and control system are arranged to control the atmosphere of the enclosure. The control system functions primarily as a means for reducing the oxygen concentration to prevent combustion. This is achieved by flooding the enclosure with an inert gas in order to render the atmosphere nonflammable, or non-ignitable, thereby reducing the potential for an explosion due to a combustible gas leak from a riser. In addition to inerting, the system also functions as a means for venting, gas-freeing, and ventilating the enclosure atmosphere. Thus, the system has the capability for;

(1) Inerting the enclosure by reducing the oxygen concentration of the atmosphere to a level at which combustion cannot be supported, regardless of the amount of combustibles present;

(2) Maintaining the atmosphere of the enclosure in an inerted condition while production is on-line;

(3) Venting combustible gas to mitigate leaks within the enclosure;

(4) Purging the enclosure of combustible gas with inert gas, so that subsequent gas-freeing operations will at no time create a flammable atmosphere;

(5) Eliminating the need for air to enter the enclosure during normal operations except when it is necessary for the enclosure to be gas-free of inert gas; and (6) Ventilating the enclosure with fresh air whenever personnel are required to enter the enclosure for extended periods of time to perform major maintenance activities.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A floating production, storage and offloading vessel, comprising:

(a) a spider buoy and an internal turret mechanism defining a substantially closed chamber having petroleum product risers therein and at times containing air;

(b) a source of inert gas being in communication with said substantially closed chamber and being controlled for injection of the inert gas therein for mixing and diluting the oxidant content of the air by introducing within the substantially closed chamber a quantity of the inert gas to render the mixture of the air and any flammable gas therein non-combustible regardless of the flammable gas content therein;

(c) a pressure vent system being in communication with the substantially closed chamber and having a normal pressure relief setting for maintaining gas pressure within the substantially closed chamber at a predetermined pressure level above atmospheric pressure and venting gas pressure in the event of increase thereof above said normal pressure relief setting;

(d) an exhaust/vent system having at least one exhaust fan and being in communication with the substantially closed chamber and being operative for forcibly exhausting gas from the substantially closed chamber for air ventilation of the substantially closed chamber; and (e) an atmosphere control system controlling injection of the inert gas into said substantially closed chamber to maintain the gas mixture therein non-combustible and being operable for shutting off injection of the inert gas into said substantially closed chamber, exhausting the inert gas from said substantially closed chamber and ventilating said substantially closed chamber with the air.

2. The floating production, storage and offloading vessel of claim 1, comprising:

(a) said internal turret mechanism being rotatably mounted to said spider buoy, with said spider buoy defining a floor of the substantially closed chamber and said turret mechanism defining wall and roof structure of the substantially closed chamber;

(b) at least one hatch being provided in said roof structure to provide for personnel access into the substantially closed chamber.

3. The floating production, storage and offloading vessel of claim 2, comprising:

said wall roof and floor structure defining the substantially closed chamber withstanding an overpressure within the substantially closed chamber in the range of 300 kPa from a combustible gas release of up to 500 kg/s within the substantially closed chamber.

4. The floating production, storage and offloading vessel of claim 2, comprising:

said source of inert gas, said pressure vent system and said exhaust vent system penetrating said roof structure for communication with the substantially closed chamber.

5. The floating production, storage and offloading vessel of claim 1, comprising:

said source of inert gas having an inert gas distribution header located within the substantially closed chamber for distribution of the inert gas therein.

6. The floating production, storage and offloading vessel of claim 1, wherein said source of inert gas comprising:

(a) an inert gas generator for extracting the inert gas from the air;

(b) an inert gas supply conduit being in communication with the substantially closed chamber and conducting the inert gas into the substantially closed chamber at a pressure in excess of the atmospheric pressure;

(c) a back-up inert gas supply being in communication with said inert gas supply conduit; and inert gas supply control elements selectively controlling supply of the inert gas from said inert gas generator and said back-up inert gas supply to the substantially closed chamber.

7. The floating production, storage and offloading vessel of claim 1, comprising:

an atmosphere monitoring system being located within the substantially closed chamber and rendering an alarm when the oxygen content of the gas mixture within the substantially closed chamber is measured to be above a predetermined maximum.

8. The floating production, storage and offloading vessel of claim 1, comprising:

an atmosphere monitoring system being located within the substantially closed chamber and rendering an alarm when a flammable material is measured to be present within the substantially closed chamber.

9. The floating production, storage and offloading vessel of claim 1, comprising:

said exhaust/vent system being selectively operative to force the air into the substantially closed chamber to purge the inert gas during a gas-freeing operation and for providing fresh air within the substantially closed chamber continuously and exhausting any contaminants from said substantially closed chamber during ventilation.

10. A floating production, storage and offloading vessel, comprising:

(a) a spider buoy and an internal turret mechanism defining a substantially closed chamber having petroleum product risers therein and having at least one hatch that is opened for admission of the air into said substantially closed chamber;

(b) a source of the inert gas being in communication with said substantially closed chamber and being controlled for injection of inert gas therein for mixing and diluting the oxidant content of the air by introducing within the substantially closed chamber to render the mixture of the air and any flammable gas therein non-combustible regardless of the flammable gas content therein;

(c) a pressure vent system being in communication with the substantially closed chamber and having a normal pressure relief setting for maintaining gas pressure within the substantially closed chamber at a predetermined pressure level above atmospheric pressure and venting gas pressure in the event of increase thereof above said normal pressure relief setting;

(d) an exhaust/vent system having at least one exhaust fan and being in communication with the substantially closed chamber and being operative for forcibly exhausting gas from the substantially closed chamber for air ventilation thereof; and (e) an inert gas supply and exhaust control system for controlling the supply of the inert gas into the substantially closed chamber and for stopping the supply of the inert gas into the substantially closed chamber and activating said exhaust/vent system for forcibly purging the inert gas with the air admitted through the open hatch to enable personnel entry into the substantially closed chamber.

* * * * *